US007971816B2

(12) United States Patent
Andrina

(10) Patent No.: US 7,971,816 B2
(45) Date of Patent: Jul. 5, 2011

(54) CRUSHING APPARATUS FOR DEMOLITION OR SIMILAR WORKS

(75) Inventor: Giovanni Andrina, Turin (IT)

(73) Assignee: Corimag S.R.L. (IT)

( * ) Notice: Subject to any disclaimer, the term of this patent is extended or adjusted under 35 U.S.C. 154(b) by 117 days.

(21) Appl. No.: 12/363,904

(22) Filed: Feb. 2, 2009

(65) Prior Publication Data

US 2009/0194619 A1 Aug. 6, 2009

(30) Foreign Application Priority Data

Jan. 31, 2008 (IT) ..... TO2008A0074

(51) Int. Cl.
*B02C 1/02* (2006.01)

(52) U.S. Cl. ..... 241/101.73; 241/266

(58) Field of Classification Search ..... 241/101.73, 241/266

See application file for complete search history.

(56) References Cited

U.S. PATENT DOCUMENTS

| | | | | |
|---|---|---|---|---|
| 5,044,569 | A * | 9/1991 | LaBounty et al. | 241/266 |
| 5,199,658 | A * | 4/1993 | Bartels et al. | 241/266 |
| 5,480,100 | A * | 1/1996 | Tagawa et al. | 241/266 |
| 5,626,301 | A * | 5/1997 | Morikawa et al. | 241/266 |
| 6,119,970 | A * | 9/2000 | LaBounty et al. | 241/101.73 |
| 2006/0032955 | A1 * | 2/2006 | Kimura et al. | 241/101.73 |
| 2007/0001041 | A1 * | 1/2007 | Christenson | 241/101.73 |

* cited by examiner

*Primary Examiner* — Faye Francis
(74) *Attorney, Agent, or Firm* — Hayes Soloway P.C.

(57) ABSTRACT

A crushing apparatus for demolition works includes a main body having a connecting portion intended to be connected to the end of a handling arm, and at least a swingable jaw articulated to the main body at a distal portion with respect to the connecting portion, which is adapted to allow, during a demolition work, that a member to be demolished is grasped. Actuator devices are interposed between each swingable jaw and the main body, which are intended to control the movement of the respective jaw. The apparatus also includes percussion devices adapted to carry out an action of percussion on a member to be demolished, which it is grasped by said at least one jaw.

9 Claims, 2 Drawing Sheets

CRUSHING APPARATUS FOR DEMOLITION OR SIMILAR WORKS

BACKGROUND OF THE INVENTION

The present invention refers in general to apparatuses to be used for performing demolition works, for example for breaking up members of a building structure, such as concrete beams or pillars, or in quarries during works carried out in order to crush blocks, stones or similar materials.

More particularly, the invention relates to a crushing apparatus for demolition or similar works.

Apparatuses of the type known mentioned above are commonly used for breaking up structural members of buildings during demolition works, and comprise a main body intended to be removably associated to the free end of an articulated handling arm of an operational machine such as an excavator. A pair of jaws, which may be provided with teeth and/or shear blades, and at least one of which is movable, is associated to the main body. The movement of the movable jaws is controlled by actuators, usually consisting of a fluid cylinder, so that a member to be demolished can be grasped between the jaws of the main body, and it can be broken up as a result of the compressive force applied by driving the aforesaid actuators.

However, this manner of acting has the drawback of requiring a considerable amount of time, since the breaking up action carried out by compression applied through the jaws is progressive and, after all, rather slow. In particular, breaking up of concrete bodies or stone blocks by compression requires a very high power, because crushing only happens if a pressure is attained which is higher than that corresponding to the compressive strength of the material, which is usually very high, while impact strength of such materials is smaller.

SUMMARY OF THE INVENTION

By virtue of the fact that the apparatus according to the invention is provided with percussion means associated with the main body, which are intended to apply a percussion force to the material to be demolished, together with the compressive action performed by the jaws, the demolition work turns out to be extremely effective and allows the time of demolition to be considerably reduced. Moreover, the demolition apparatus of the invention has a simple structure, and can be manufactured at a low cost starting from componentry which is mostly available on the market.

According to a preferred feature of the invention, the actuator means of the swingable jaws incorporate percussion means, so that the action of percussion is concentrated mostly on each swingable jaw.

In this manner, the jaws simultaneously carry out a concentrated action, both of compression and percussion, on a member to be crushed, and therefore perform a very effective breaking up action.

According to another preferred feature of the invention, the percussion means are associated with the main body of the apparatus in a manner independent of each swingable jaw, and include at least one demolishing unit provided with a respective tool projecting from the distal portion of the main body.

In this manner, the action of percussion of the demolishing unit is carried out when a member to be demolished is already firmly grasped by the jaws, which allows, on the one hand, that the action of percussion is applied to a preselected zone of the member and, on the other hand, that the breaking up action by compression of the jaws is made more effective, by virtue of the fact that percussion of the demolishing unit allows to weaken the member to be broken up, which makes easier breaking up thereof by compression.

Further characteristics and advantages of the invention will turn out to be clearer from the following detailed description, which has been provided as a non-limiting example and is referred to the appended drawings in which:

DETAILED DESCRIPTION OF THE INVENTION

Figure 1:
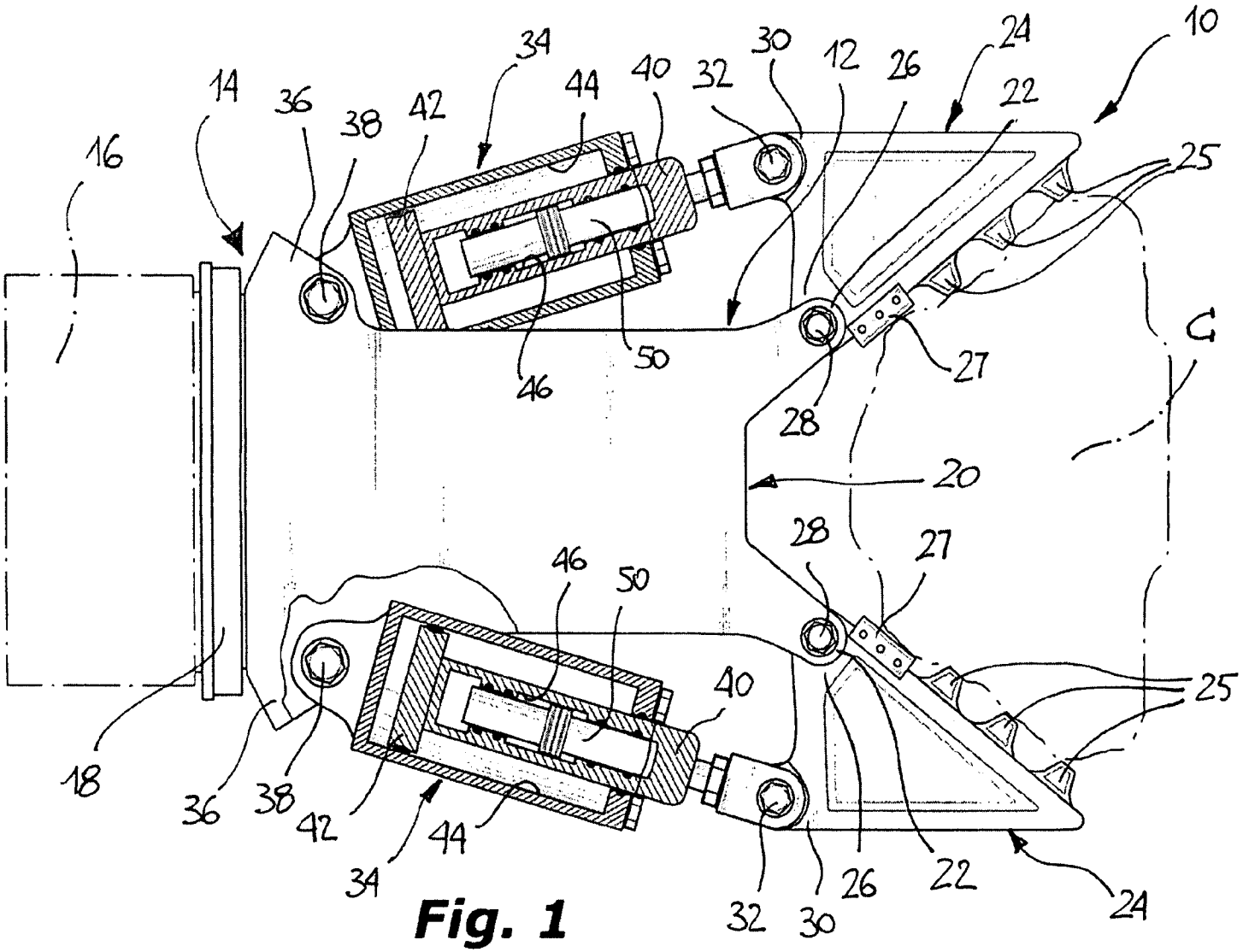
FIG. 1 is a schematic side elevational view of a first embodiment of an apparatus of the invention.

With initial reference to FIG. 1, a crushing apparatus for demolition or similar works, made according to a first embodiment of the invention, is indicated 10 in its whole. The apparatus 10 comprises an elongated main body 12 having a first portion 14 intended to be removably connected to the free end of a handling arm, schematically indicated 16, of an operational machine, with the aim of carrying the apparatus 10 close to a member C, typically of concrete or reinforced concrete, to be demolished.

The body 12 is usually rotatably mounted on a fifth wheel support member 18, in order to allow rotation thereof about its general axis with respect to the arm 16.

The second end 20, or distal end, of the body 12, opposite to the first end 14, is conveniently fork shaped being defined by a pair of appendages 22 which are preferably symmetrical with respect to the general axis of the body 12, a respective jaw 24, swingably mounted, being associated with each appendage.

In particular, each jaw 24 has a first portion of articulation 26 crossed by a first pin 28 which also engages a pair of coaxial holes of the respective appendage 22, and a second portion of articulation 30 crossed by a second pin 32 for articulation to a first end 40 of a fluid cylinder 34, usually of the double acting type, the opposite end of which is articulated to the body 12 at 36 through a third pin 38.

The cylinders 34 constitute actuator means for actuating the jaws 24, which are adapted to control the opening thereof with respect to the body 12 as a result of feeding and releasing a fluid through respective ducts (not shown) associated with the opposite ends of a working chamber 44 in which a piston 42 is slidably mounted. The piston 42 is connected to a rod 40 which constitutes the aforesaid first end of the cylinder 34 articulated to the pin 32, and which incorporates percussion means preferably consisting of a cylindrical beating body 50 slidably mounted in an elongated chamber 46 formed coaxially in the rod 40. The beating body 50 is driven according to a to-and fro motion by a hydraulic or pneumatic control device of a type known per se, which is commonly used in demolishing hammers.

Preferably, each jaw 24 is provided with teeth shaped projecting formations 25, to make easier crushing of the member C, and/or shear blade shaped formations 27, in order to allow that possible reinforcing rods within the element C are cut.

Although a crushing apparatus provided with a pair of jaws 24 has been previously described, of course also a crushing apparatus provided with a single movable jaw 24 falls within the invention, in which case the body 12 will have a portion projecting from its end 20 and adapted to constitute a stationary jaw facing the single movable jaw 24.

The apparatus 10 of the present embodiment of the invention allows that a very effective breaking up action is carried out by virtue of the combination of the compressive action performed by each swinging jaw 24 as a result of driving the respective cylinder 34, together with the action of percussion carried out by the percussion unit associated to each cylinder 34, the combined actions of percussion and compression being mostly concentrated on each swingable jaw 24.

In particular, in the operation of the apparatus 10, during a demolition work a member C to be demolished is grasped between the jaws 24 by controlling the extension of the cylinders 34 and, simultaneously or selectively, the respective percussion units are driven in order to make easier the compressive action of the jaws 24 as well as the penetration of the teeth 25 thereof into the member C, in order to make therefore more effective and faster the demolition work.

Figure 2:
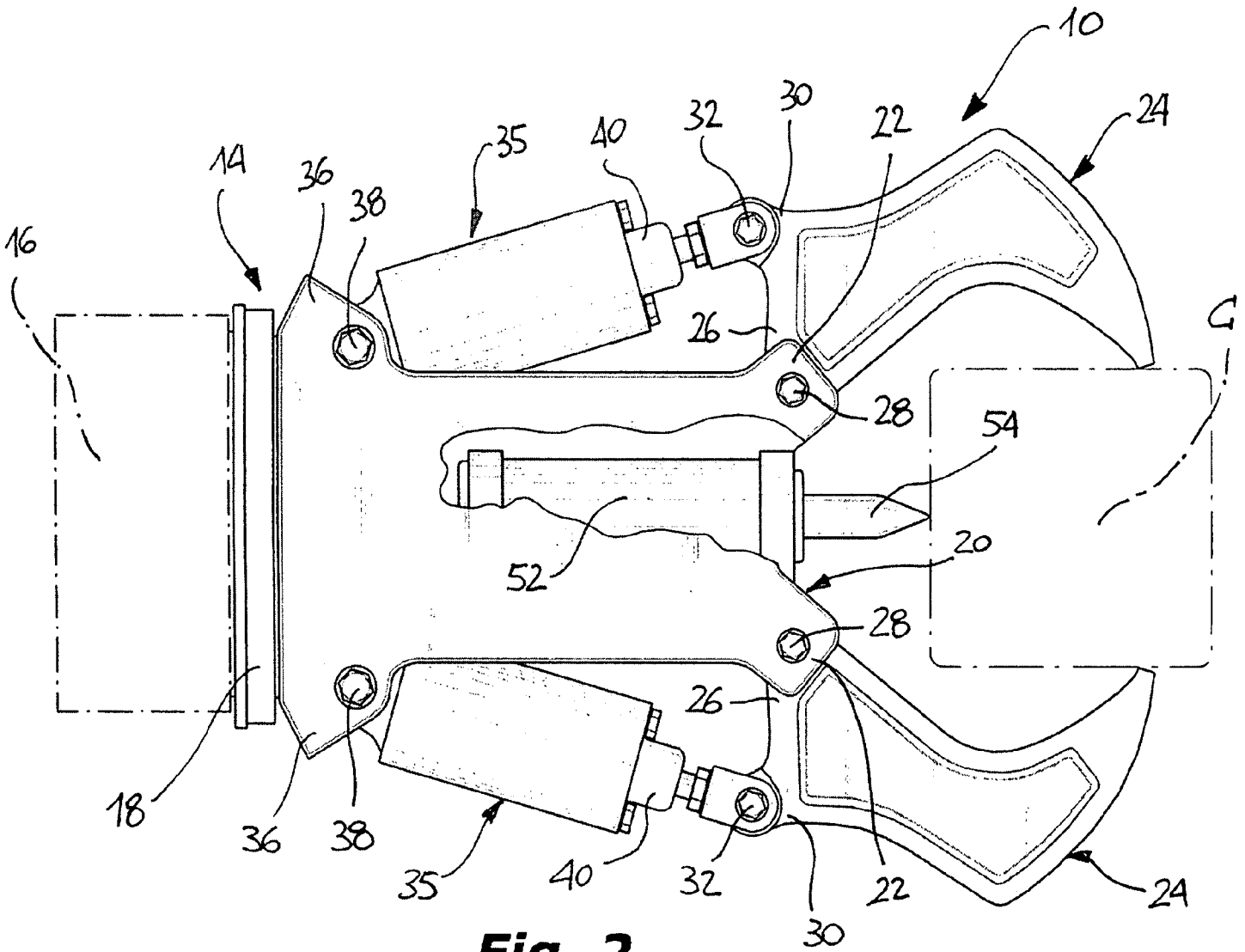
FIG. 2 is a schematic side elevational view of an another embodiment of an apparatus of the invention.

According to an other embodiment of the invention shown in FIG. 2, in which the same numeral references of the previous embodiment have been used to indicate elements equal or similar to it, the apparatus 10 has a general structure similar to that previously described, except for the fact that the cylinders 35 which control the movement of the swingable jaws 24 are of the traditional type, typically of the double acting type.

In this case, the percussion means are directly associated with the main body 12, in a manner independent of the jaws 24, and consist of at least a demolishing unit 52, of the type per se known which usually outfits demolishing hammers, and which includes therefore an elongated chamber in which a beating body is slidably mounted, which is adapted to be driven according to a to-and-fro motion as a result of driving a hydraulic or pneumatic control device. A tool 54, for example a bit shaped tool, is associated with such a beating body, which is arranged so as to project from the distal portion 20 of the body 12, preferably in a middle position between the jaws 24.

Also in this case, in spite of the fact that an apparatus provided with a pair of movable jaws 24 has been described, the invention comprises also a crushing apparatus having a single movable jaw 24 and another stationary jaw facing it, which extends from the end 20 of the body 12.

The apparatus according to this embodiment allows that a member C, grasped between the jaws 24, is broken up owing to the extension of the cylinders 35, both as a result of the compressive action performed by the jaws 24, and of the action of percussion carried out by the tool 54 owing to the activation of the percussion unit 52. In particular, during the demolition work, the action of the tool 54 is made easier since the member C, which is firmly grasped by the jaws 24, can be held in a fixed position, and therefore the action of percussion of the tool 54 can be better concentrated at a preselected zone thereof. Also in this case, both the compressive action of the jaws 24 and the action of percussion of the tool 54, which can be carried out selectively or simultaneously, allow that the breaking up action of a member C to be demolished is made more effective and faster.

What is claimed is:

1. An apparatus for demolishing an object comprising:

a main body provided with a connecting portion for connecting the main body to the end of a handling arm;

a first jaw extending from a distal portion of the main body;

a second jaw, swingably articulated to said distal portion of the main body opposable to said first jaw such that the object to be demolished may be grasped and compressed between said first and second jaws;

an actuator interposed between said second jaw and the main body for controlling movement of said second jaw; and a percussion tool for applying a percussion to the object to be demolished while it is compressed between said jaws, wherein said percussion tool comprises a beating body slidably mounted in a working chamber disposed within said actuator.

2. The apparatus according to claim 1, wherein each jaw is provided with projecting teeth for penetrating into the object to be demolished while the object is compressed between said jaws, and wherein said second jaw comprises a first articulation for connection with the main body and a second articulation for rotary connection with an end of said actuator.

3. The apparatus according to claim 1, wherein said first jaw is swingably articulated to said distal portion of the main body, and said apparatus further comprises an actuator interposed between said first jaw and the main body for controlling movement of said first jaw.

4. The apparatus according to claim 3, wherein the actuator associated with each respective jaw includes a percussion tool comprising a beating body slidably mounted in an elongated chamber disposed within each respective actuator.

5. The apparatus according to claim 4, wherein each of said actuators includes an actuator cylinder that comprises a double acting cylinder including a piston that is fixed to a rod and is slidably mounted in a working chamber, and wherein said elongated chamber in which the beating body is slidably mounted is formed coaxially in said rod.

6. An apparatus for demolishing an object, comprising:

a main body provided with a connecting portion for connecting the main body to an end of a handling arm;

a first jaw extending from a distal portion of the main body;

a second jaw swingably articulated to said distal portion of the main body opposable to said first jaw such that the object to be demolished may be grasped and compressed between said first and second jaws;

an actuator interposed between said second jaw and the main body for controlling movement of said second jaw; and a percussion tool for applying a percussion to the object to be demolished while it is compressed between said jaws;

wherein said percussion tool is associated with the main body in a manner independent of said first and second jaws, and includes at least one demolishing unit provided with a respective tool projecting from a distal portion of the main body.

7. The apparatus according to claim 6, wherein said demolishing unit includes an elongated chamber in which a beating body is slidably mounted for causing motion of said tool.

8. The apparatus according to claim 6, wherein said first jaw is swingably articulated to said distal portion of the main body, and said apparatus further comprises an actuator interposed between said first jaw and the main body for controlling movement of said first jaw, and each jaw comprises a first portion of articulation for the rotary connection to the main body, and a second portion of articulation for the rotary connection to an end of the respective actuator.

9. The apparatus according to claim 6, wherein said at least one demolishing unit is connected to the main body in a middle position between said first and second jaws.

* * * * *